US007146817B2

(12) United States Patent
Baudat

(10) Patent No.: US 7,146,817 B2
(45) Date of Patent: Dec. 12, 2006

(54) COLD BOX STORAGE APPARATUS FOR LNG TANKS AND METHODS FOR PROCESSING, TRANSPORTING AND/OR STORING LNG

(75) Inventor: Ned P. Baudat, New Branfels, TX (US)

(73) Assignee: Mustang Engineering L.P., Houston, TX (US)

( * ) Notice: Subject to any disclaimer, the term of this patent is extended or adjusted under 35 U.S.C. 154(b) by 101 days.

(21) Appl. No.: 10/782,736

(22) Filed: Feb. 19, 2004

(65) Prior Publication Data

US 2006/0225436 A1 Oct. 12, 2006

(51) Int. Cl.
*F17C 9/02* (2006.01)

(52) U.S. Cl. ..... 62/50.2; 62/45.1; 220/560.1

(58) Field of Classification Search ..... 62/45.1, 62/50.2, 53.2, 240; 220/560.1, 560.11, 560.03; 114/74 A See application file for complete search history.

(56) References Cited

U.S. PATENT DOCUMENTS

| | | | | | |
|---|---|---|---|---|---|
| 3,145,680 | A * | 8/1964 | Farkas et al. | ..... | 114/74 A |
| 3,537,416 | A * | 11/1970 | Cowles | ..... | 114/74 A |
| 3,830,180 | A * | 8/1974 | Bolton | ..... | 117/74 A |
| 3,863,460 | A * | 2/1975 | Straile et al. | ..... | 114/74 A |
| 3,886,885 | A * | 6/1975 | Becker et al. | ..... | 114/74 A |
| 5,284,191 | A * | 2/1994 | McGarvey | ..... | 220/560.03 |
| 5,570,714 | A * | 11/1996 | Magish | ..... | 220/560.03 |
| 6,085,528 | A * | 7/2000 | Woodall et al. | ..... | 62/53.2 |
| 2002/0046773 | A1 * | 4/2002 | Bishop et al. | ..... | 137/259 |

* cited by examiner

*Primary Examiner*—William C. Doerrler
(74) *Attorney, Agent, or Firm*—GilbrethRoebuck; J. M. (Mark) Gilbreth; Mary A. Gilbreth

(57) ABSTRACT

A cryogenic fluid storage/processing system which includes a cement box in which is positioned a multiplicity of tanks arranged parallel in one or more layers and surrounded by perlite insulation, and in which is positioned a pump for filling/emptying the tanks. A vaporizer the vaporizing the tank contents is mounted on or adjacent to the box.

18 Claims, 2 Drawing Sheets

Fig. 3
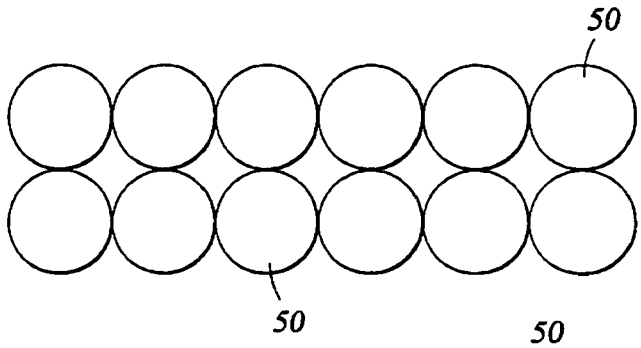
Fig. 4
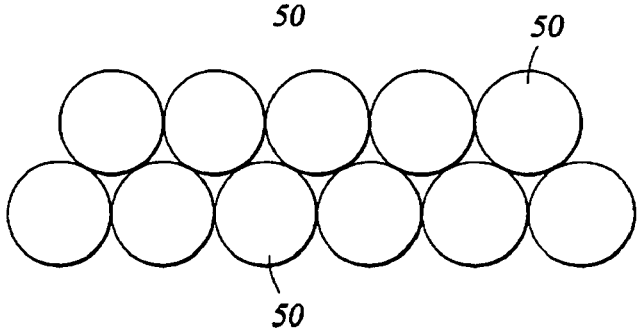
Fig. 5
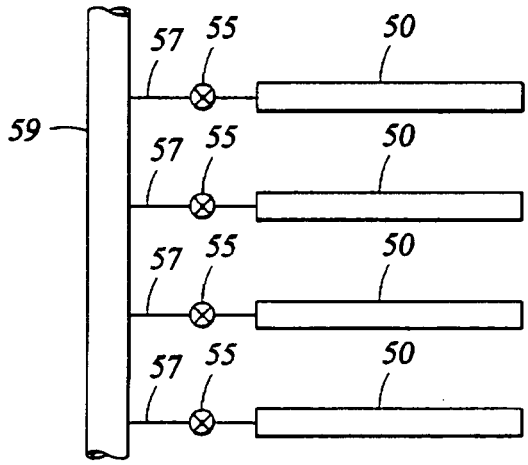
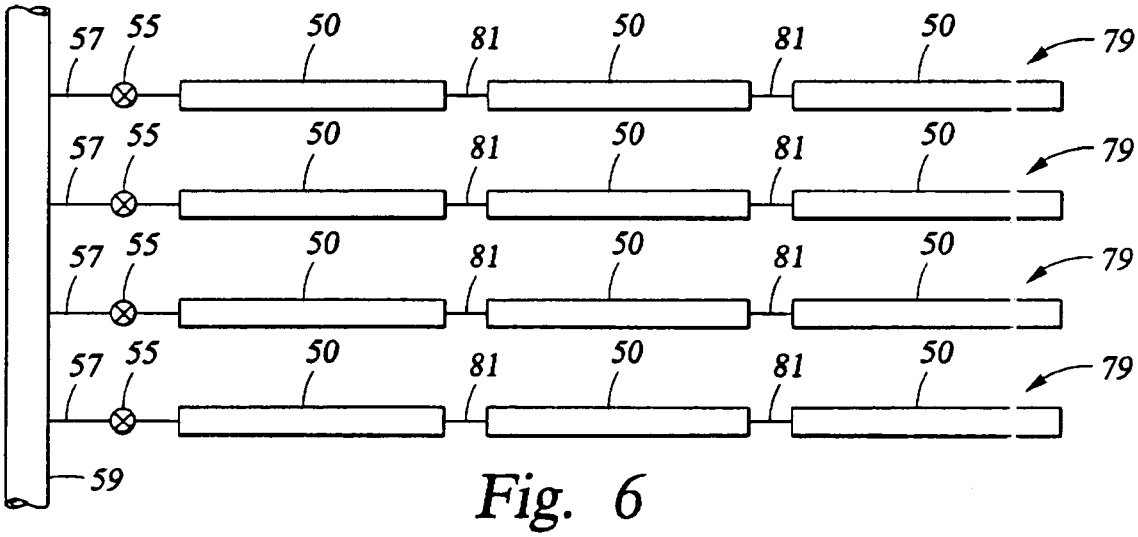
Fig. 6

COLD BOX STORAGE APPARATUS FOR LNG TANKS AND METHODS FOR PROCESSING, TRANSPORTING AND/OR STORING LNG

BACKGROUND OF THE INVENTION

1. Field of the Invention

The present invention relates to cryogenic fluids. In another aspect, the present invention relates to storage apparatus for and methods for processing, transporting and/or storing cryogenic fluids. In even another aspect, the present invention relates to methods and apparatus for processing, transporting and/or storing liquified natural gas ("LNG").

2. Description of the Related Art

Interest in the use of liquified natural gas (LNG) as a fuel for motor vehicles has increased dramatically in recent years. Entire fleets of government and industrial vehicles have successfully been converted to natural gas. Some privately-owned vehicles have been converted as well. Congress has passed an energy bill that requires increased use of alternative fuels in government and private fleets. Several factors have influenced this increasing use of LNG as a fuel in motor vehicles. LNG is relatively inexpensive. In addition, it burns very cleanly, making it much easier for fleets to meet more restrictive pollution emission standards. And, in terms of reducing dependence on imported oil, natural gas is abundantly available in the United States.

Most conveniently, natural gas is transported from the location where it is produced to the location where it is consumed by a pipeline. However, given certain barriers of geography, economics, and/or politics, transportation by pipeline is not always possible, economic or permitted. Without an effective way to transport the natural gas to a location where there is a commercial demand, the gas may be burned as it is produced, which is wasteful.

Liquefaction of the natural gas facilitates storage and transportation of the natural gas (a mixture of hydrocarbons, typically 65 to 99 percent methane, with smaller amounts of ethane, propane and butane). When natural gas is chilled to below its boiling point (in the neighborhood of −260° F. depending upon the composition) it becomes an odorless, colorless liquid having a volume which is less than one six hundredth (1/600) of its volume at ambient atmospheric surface temperature and pressure. Thus, it will be appreciated that a 150,000 cubic meter LNG tanker ship is capable of carrying the equivalent of 3.2 billion cubic feet of natural gas.

When LNG is warmed above its boiling point, it boils reverting back to its gaseous form.

The growing demand for natural gas has stimulated the transportation of LNG by special tanker ships. Natural gas produced in remote locations, such as Algeria, Borneo, or Indonesia, may be liquefied and shipped overseas in this manner to Europe, Japan, or the United States. Typically, the natural gas is gathered through one or more pipelines to a land-based liquefaction facility. The LNG is then loaded onto a tanker equipped with cryogenic compartments (such a tanker may be referred to as an LNG carrier or "LNGC") by pumping it through a relatively short pipeline. After the LNGC reaches the destination port, the LNG is offloaded by cryogenic pump to a land-based regasification facility, where it may be stored in a liquid state or regasified. If regasified, the resulting natural gas then may be distributed through a pipeline system to various locations where it is consumed.

Of the known liquid energy gases, liquid natural gas is the most difficult to handle because it is so intensely cold. Complex handling, shipping and storage apparatus and procedures are required to prevent unwanted thermal rise in the LNG with resultant regassification. Storage vessels, whether part of LNG tanker ships or land-based, are closely analogous to giant thermos bottles with outer walls, inner walls and effective types and amounts of insulation in between.

LNG storage tanks in the United States have heretofor been built mostly above the ground with some frozen pit facilities properly characterized as mostly above the ground. Most such tanks have been enclosed by a low rising earthen dike. Such dikes were sized and placed to enclose an area and volume at least as great as the storage capacity of the largest tank (if not all of the tanks) within the diked area.

In addition, National Fire Protection Association (NFPA) guidelines (NFPA 59A, Para 108) for spill containment require impounding areas that hold the entire LNG capacity of the station in the event of a catastrophic spill. Furthermore, in accordance with NFPA guidelines, electrical controls must either be designed for explosion-proof conditions or be situated in designated safe areas outside of the impoundment area generally several hundred feet away. As explosion-proof controls are costly, the latter option is preferable.

Thus, LNG to be regasified is generally pumped to a heating device situated outside the impoundment area several hundred feet away in a designated safe area.

In spite of the presence of insulation, storage tanks will still cool if not freeze any ground in direct contact with the tank. Thus, an electrical heating element is placed in the ground to counter any cooling by the tank.

A number of patents relate to the processing, transporting, and storing of LNG.

U.S. Pat. No. 3,675,431 issued Jul. 11, 1972 to Jackson, discloses a partially submerged offshore storage tank for liquified energy gases. That patent described an insulated tank which was prefabricated, floated to a suitable offshore site and then sunk until its submerged base rested on the floor of the sea. An upper above-the-water domed metal cylinder extended from a concrete base. Insulation lined the interior of the tank. A thin and flexible membrane inside the insulation provided the required liquid tight interior lining of the tank. The insulation lining the submerged portion of the tank was said to be thinned, so that a layer of ice formed around the outside of the concrete base when the tank was filled with liquified gas. In accordance with the invention claimed in the patent, the ice layer supposedly acted as an outer seal for the submerged concrete.

U.S. Pat. No. 3,727,418, issued Apr. 17, 1973, to Glazier, discloses an LNG storage facility having an insulated interior membrane. A balancing fluid, said to be isopentane (2-methyl butane) transferred hydrostatic pressure from surrounding ambient water to the LNG contents.

U.S. Pat. No. 3,828,565, issued Aug. 13, 1974 to McCabe, discloses an insulated buoyant tank moved telescopically up and down in a larger receiver tank containing seawater, oil or other liquid in accordance with the quantity of LEG at atmospheric pressure stored therein from time to time.

U.S. Pat. No. 4,041,722, issued Aug. 16, 1977, to Terlesky et al., discloses an impact resistant tank for storing cryogenic fluids, includes an inner metal tank having a metal side wall and a metal bottom and a concrete outer wall around the inner metal wall and having reinforcement therein to resist impact loads thereon, and to serve as a secondary containment for the cryogenic fluid. A multiplicity of dual purpose separating plates not only ensure a rigid structure for the tank, they effectively divide up the tank into separate storage compartments, thus minimizing leakage to that compartment with a fracture.

U.S. Pat. No. 4,209,267, issued Jun. 24, 1980, to Gnaedinger, proposes an improvement over the traditional earthen dike system around LNG storage tanks. Specifically, the storage system comprises a dike, impounding wall or drainage channel constructed of compacted earth, concrete, metal and/or other suitable substance surrounding an above-ground steel insulated tank used to store the liquefied gas. A drop shaft is used to communicate the diked area with an underground tunnel for temporary accumulation and subsequent safe disposal of liquid which has escaped from the storage tank.

U.S. Pat. No. 4,374,478, issued Feb. 22, 1983, to Secord et al., discloses tanks for land storage of liquefied gas at low temperature at or above atmospheric pressure. The invention provides a storage tank of the kind in which the walls are formed by a multiplicity of connected, parallel, part-cylindrical lobes presenting outwardly convex arcuate surfaces, which is characterized in that the side and end walls thereof are provided by a single tier of connected lobes, in that said lobes extend in one common direction over the tank, in that the end walls of the tank comprise part-spherical knuckles closing off the ends of the part-cylindrical lobes, and in that a separating plate is provided at each lobe connection to strengthen the tank against internal pressure and to divide it into separate storage compartments.

U.S. Pat. No. 5,682,750, issued Nov. 4, 1997, to Preston et al., discloses a portable self-contained delivery station for liquid natural gas (LNG) is provided on a movable skid frame and equipped with an instant-on delivery system which may initiate LNG delivery immediately to a use vehicle. The skid is equipped with a spill containment feature such that the LNG may be contained in the event of spillage. A variable speed pump both controls LNG dispensing and saturation levels of the stored LNG. The pump is submerged in a sump tank which is separate from the bulk storage tank. The sump tank is flooded with an amount of LNG such that the pump is submerged. Delivery of LNG may thus occur instantly, without pre-cooling of the pump or associated meter.

U.S. Pat. No. 6,640,554, issued Nov. 4, 2003, to Emmer et al., discloses a portable self-contained liquid natural gas (LNG) dispensing system is housed in a container featuring opposing side and end walls and a bottom panel. The container is divided into a ventilated portion and a covered portion. A roof is over the covered portion while the ventilated portion features an open top. A bulk tank positioned within the container contains a supply of LNG with a head space thereabove and a pump is submerged in LNG within a sump that is also positioned within the container and communicates with the bulk tank. The container is lined with stainless steel sheets to define a containment volume that is capable of holding the entire supply of LNG in the bulk tank. A vent valve communicates with the head space of the bulk tank and is positioned under the open top of the ventilated portion of the container. The electric controls are positioned on the lower portion of the end wall of the covered portion of the container so as to be located in accordance with the appropriate safety guidelines.

All of the patents cited in this specification, are herein incorporated by reference.

However, in spite of the above advancements, there still exists a need in the art for apparatus and methods for processing, transporting, and/or storing LNG.

This and other needs in the art will become apparent to those of skill in the art upon review of this specification, including its drawings and claims.

SUMMARY OF THE INVENTION

It is an object of the present invention to provide for improved apparatus and methods for processing, transporting, and/or storing LNG.

This and other objects of the present invention will become apparent to those of skill in the art upon review of this specification, including its drawings and claims.

According to one embodiment of the present invention, there is provided an apparatus comprising, a sealed containment box, a multiplicity of tanks positioned within the box, a pump system positioned within the box and in liquid communication with the tanks, and a vaporizer positioned outside the box and in liquid communication with the pump system.

According to another embodiment of the present invention, there is provided an apparatus comprising, a sealed containment box, comprising a tank section, and a pump section, a multiplicity of tanks positioned within the box, a pump system positioned within the box and in liquid communication with the tanks, and a vaporizer positioned outside the box and in liquid communication with the pump system. In this embodiment, the tank section comprises tanks and defines an impoundment section outside the tanks having a volume sufficient to hold any contents in the tanks, and the pump section defines an impoundment section having a volume sufficient to hold the contents of at least one tank.

According to even another embodiment of the present invention, there is provided an apparatus comprising, a land or marine vehicle, a sealed containment box supported by the vehicle, a multiplicity of tanks positioned within the box, a pump system positioned within the box and in liquid communication with the tanks, a vaporizer positioned outside the box and in liquid communication with the pump system.

According to yet another embodiment of the present invention, there is provided a method of processing a cryogenic fluid comprising placing cryogenic fluid inside a multiplicity of tanks positioned within the tank section of a containment box, wherein the box comprises a pump system positioned within the box and in liquid communication with the tanks, and comprises a vaporizer positioned outside the box and in liquid communication with the pump system.

According to even still other embodiments of the present invention, various methods of processing, storing, transporting, and vaporizing LNG are provided as described herein.

These and other embodiments of the present invention will become apparent to those of skill in the art upon review of this specification, including its drawings and claims.

BRIEF DESCRIPTION OF THE DRAWINGS

In the drawings, it should be understood that like reference numbers refer to like members.

FIG. 3 shows a non-limiting example of a tank arrangement, in which the tanks are arranged in a first (bottom) layer of 6 tanks parallel to each other, and in a second (top) layer of 6 tanks aligned directly on top of the bottom layer.

FIG. 4 shows a non-limiting example of a tank arrangement, in which the tanks are arranged in a first (bottom) layer of 6 tanks parallel to each other, and in a second (top) layer of 5 tanks parallel to each other, with the tanks of the top layer offset from tanks of the bottom layer by the radius of the tanks.

FIG. 5 shows tanks 50 connected to the manifold in a parallel arrangement.

FIG. 6 shows tanks 50 in which each group of tanks 79 comprises a linear arrangement of tanks, with each group of tanks 79 connected in parallel to header 59.

DETAILED DESCRIPTION OF THE INVENTION

While some descriptions of the present invention may make reference to liquified natural gas ("LNG"), it should be understood that the present invention is not limited to utility with LNG, but rather has broad utility with cryogenic fluids in general, preferably cryogenic fluids formed from flammable gases.

The apparatus of the present invention will find utility for processing, storing, and/or transporting (i.e., including but not limited to, receiving, dispensing, distributing, moving) cryogenic fluids, a non-limiting example of which is liquified natural gas ("LNG").

Figure 1:
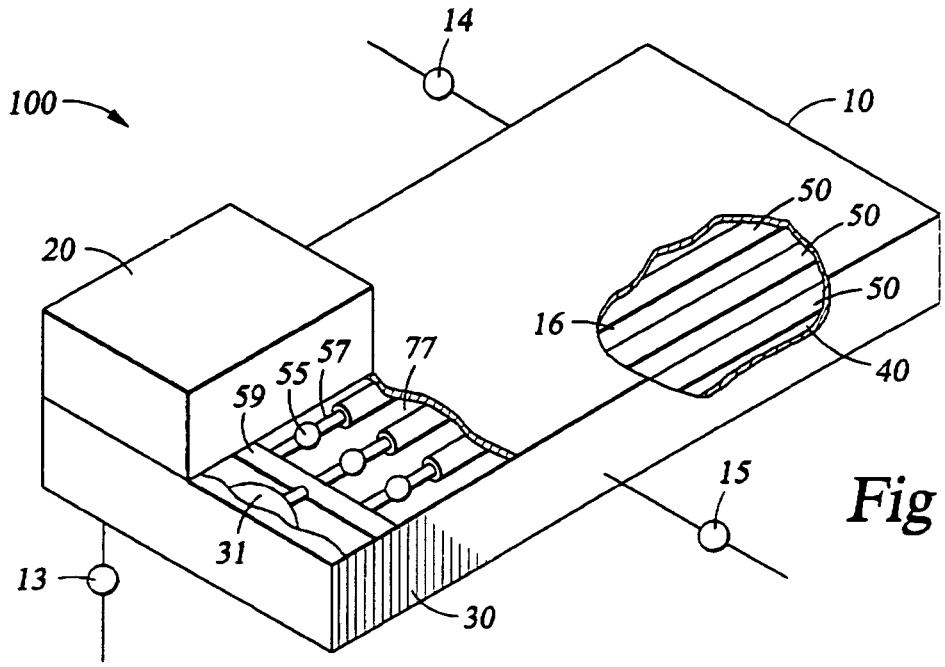
FIG. 1 shows storage system 100 of the present invention, including containment box 10 which is divided into a pump section 30 for housing the pump components, and into a storage section 40 for housing a multiplicity of storage tanks 50, with a vaporizer 20 optionally mounted to containment box 10.

Referring now to FIG. 1 there is shown a representation of storage system 100 of the present invention, including containment box 10 which is divided into a pump section 30 for housing one or more pumps 31, and into a storage section 40 for housing a multiplicity of storage tanks 50, with a vaporizer 20 optionally mounted to containment box 10.

One or more optional dividers 77 may be utilized to divide box 10 into various isolated compartments for safety and other reasons. As shown in FIG. 1, divider 77 isolates the pump section 30 from storage section 40.

Containment box 10 may be made of any material having physical properties suitable for the intended application of storage system 100. It is envisioned that storage system 100 may be utilized for in-ground storage, may be permanently affixed to a land or marine transportation vehicle, or may be transportable using a land or marine transportation vehicle. Thus, containment box 10 will be constructed accordingly as is known to those of skill in the art. Preferably, containment box 10 will comprise concrete, metal, and/or reinforced concrete.

Containment box 10 will be sized such that in the event of a leak from one or more tanks 50, containment box 10 is suitable to impound the entire contents of tanks 50. Preferably, pump section 30 will be sized suitable to hold the contents of one tank 50, more preferably the contents of one series of tanks 79. Because pump section 30 may be subjected to rain, a drain 13 may be conveniently provided.

Containment box 10 is further provided with charge line 14 and purge line 15, which can be utilized to purge an inert gas thru containment box 10 to provide an inert environment within containment box 10. Preferably, the inert gas utilized is nitrogen, although any other suitable inert gas may be utilized.

To provide the necessary thermal insulating effect, empty spaces in containment box 10 may be filled with insulation material 16, which is of a thickness and quality to maintain the gas in its liquid state with a controlled, relatively small amount of pressure rise. A suitable material for use would be perlite. Other alternatives include use of an insulated box 10, or even jacketing box 10 with insulation.

Of course, the amount/thickness of insulation utilized will vary according to the type of insulation material, and the desired pressure rise targeted. By way of non-limiting example, a mean insulation thickness of approximately 1 meter, would result in a controlled pressure rise of less than 1 psi/week (i.e., equivalent to a boil-off of less than 0.05%/day of the storage volume).

Positioned within storage section 40 are a plurality of storage tanks 50. The present invention is not intended to be limited to any particular number of, size of, nor geometric shape of, or arrangement of, tanks 50. Preferably, tanks 50 are cylindrical type tanks. Most preferably, tanks 50 are elongated horizontal cylindrical tanks, formed into one or more layers of two or more parallel tanks.

Optionally, storage section may be provided with one or more access ways to allow for maintenance, repair, inspection, and the like.

Preferably, to minimize vapor recompression, the various tanks 50 are suitable for a minimum of 15 psig operation pressure, most preferably a minimum of 50 psig operation pressure.

As one envisioned non-limiting example, storage system 100, intended to contain 100,000 $m^3$, comprises 11 elongated horizontal cylindrical tanks 50, each of 9100 $m^3$ (24' dia.×710' T/T), arranged parallel to each other in one layer.

As another envisioned non-limiting example, storage system 100, intended to contain approximately 100,000 $m^3$, comprises 11 or 12 elongated horizontal cylindrical tanks 50, each of 9100 $m^3$. With 11 tanks, it is envisioned that the tanks are arranged as shown in FIG. 4, in a first (bottom) layer of 6 tanks parallel to each other, and in a second (top) layer of 5 tanks parallel to each other, with the tanks of the top layer offset from tanks of the bottom layer by the radius of the tanks.

With 12 tanks, it is envisioned that the tanks are arranged as shown in FIG. 3, in a first (bottom) layer of 6 tanks parallel to each other, and in a second (top) layer of 6 tanks aligned directly on top of each other.

As even another envisioned non-limiting example, storage system 100, intended to contain 190,000 $m^3$, comprises 21 elongated horizontal cylindrical tanks 50, each of 9100 $m^3$, arranged in a first (bottom) layer of 11 tanks parallel to each other, and in a second (top) layer of 10 tanks parallel to each other, with the tanks of the top layer offset from tanks of the bottom layer by the radius of the tanks.

Further envisioned non-limiting examples would comprise the aforementioned non-limiting examples of system 100 with each of the 9100 $m^3$ vessels made up of multiple vessels manifolded together in series.

In the practice of the present invention, containment system 100 may be provided with one or more pumps 31 for filling tanks 50.

In a filling operation, LNG is pumped into storage system 100 through charge line 38 to header 59 where a number of lines 57 fill the various tanks 50. While manifold 59 and lines 57 could optionally be positioned within the insulated tank section 40, it would be more difficult to maintain and operate. Preferably, manifold 59 and line 57 are positioned in the pump section 30 as shown, and preferably, LNG charge line 38, manifold 59 and line 57 would be vacuum jacketed.

In an emptying operation, pump 31 pumps LNG through charge line 53 in communication with header 59, and discharges the LNG through discharge line 37 to vaporizer 20.

Containment system 100 may be provided with a manifold system 51 comprising piping, manifold header 59, fill lines 57, and manifold valves 55 to selectively fill/empty the various tanks 50. As non-limiting examples of selectively filling/emptying, the various tanks 50 may be filled/emptied in series (i.e., one after another in any order), or parallel (i.e., all at once). Such a manifold system 51 may be utilized to isolate the various tanks 50 from each other, or may be utilized to equalize the pressure between the various tanks 50.

Figure 2:
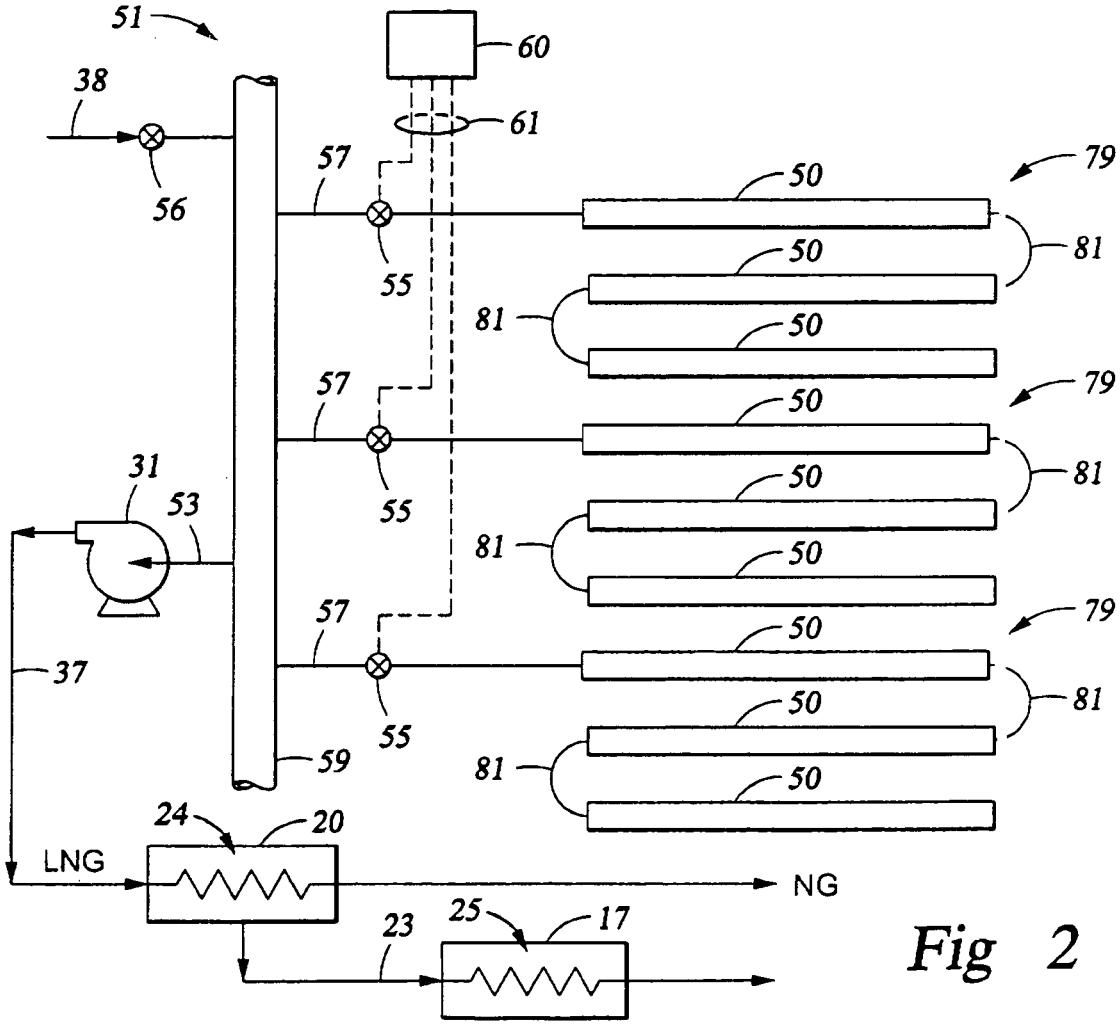
FIG. 2 is a schematic of storage system 100 showing which is divided into a pump section 30 for housing the pump components, and into a storage section 40 for housing a multiplicity of storage tanks 50, with a vaporizer 20 optionally mounted to containment box 10.

As shown in FIG. 2, to reduce the number of necessary valves 55, the various tanks 50 are arranged in groups 79 comprising three tanks connected in series by piping 81, with each group 79 connected to the manifold in parallel to the other groups 79. Of course, groups 79 may comprise any desired number of tanks, with each group 79 having the same or different number of tanks 50.

Other arrangements of tanks 50 are envisioned. As another non-limiting example, each tank 50 could be connected directly to manifold 59 as shown in FIG. 5. As even another non-limiting preferred example, FIG. 6 shows tanks 50 in which each group of tanks 79 comprises a linear arrangement of tanks, with each group of tanks 79 connected in parallel to manifold 59. This arrangement is preferred as it is believed to minimize the movement of the individual tanks in the series connections.

Controller 60 for controlling the various manifold valves 55 may be manually operated, or computer controlled. Instructions from controller 60 are relayed to the various manifold valves 55 by way of communications line 61, although it is understood that the instructions may be provided utilizing a wireless connection.

In the practice of the present invention, the various pumps 31 are not intended to be limited to any particular type of pump, but rather may be any suitable pump as known to those of skill in the art. Of course, being positioned adjacent to tanks 50 which may contain explosive materials, the pumps and attendant controls and wiring, should be adequately designed to be explosion-proof.

Pump 31 discharges through discharge line 37 into vaporizer 20 where the cryogenic fluid is vaporized into a gas. In the practice of the present invention, vaporizer 20 is not intended to be limited to any particular type of heat exchange device, but rather may be any suitable heat exchange device as known to those of skill in the art. For example, vaporizer 20 may commonly be an open rack vaporizer or ambient air vaporizer.

The present invention is not intended to be limited by the positioning of vaporizer 20. Preferably, it is preferred that vaporizer 20 be positioned immediately adjacent to box 10, preferably mounted to the side or top of box 10.

In operation, pump 31 is engaged to pump liquid LNG to be vaporized through manifold header line 53 to vaporizer 20. Heat necessary to vaporize the LNG is provided by inlet line 21 carrying the heat exchange medium (most commonly air or water). Vaporizer 20 is may optionally be operated in such a manner that the cooled heat exchange medium stream 23 still has sufficient heat to be used to warm ground or foundation 17 beneath containment system 100 (if positioned on the ground). Generally, this means that the cooled heat exchange medium is sufficiently above the freezing point of water to keep the ground thawed. Thus, cooled heat exchange medium then proceeds via outlet piping 23 to be circulated beneath system 100 forming heater 25 positioned in ground or foundation 17. Any suitable arrangement of piping may be utilized for heater 25. For example, heat 25 piping may form a spiral pattern, or run beneath system 100 in a back-and-forth manner, or any other suitable pattern or arrangement.

While the simplest manner of forming heater 25 will be to form piping into a suitable patter or arrangement, it is also contemplated that specialized baffles, manifolds or other heat exchange equipment as is known to those of skill in the heat exchange art may be utilized.

It should be understood that heater 25 may be used to completely replace the traditional electrical heaters used beneath LNG tanks, or may be used to supplement such traditional heaters.

Cryogenic storage system 100 may optionally be provided with any number of internal dividing walls 77 within box 10 to compartmentalize box 10 as desired to facilitate operation, maintenance and/or safety. Optionally, entry to box 10 may be gained by providing entryways as desired. For example, in addition to isolation pump section 30 with divider 77, a tank 50, or groups of tanks 50, may be so isolated. Preferably, each series of tanks 79, would be isolated with dividers 77.

It is anticipated, that cryogenic system 100 of the present invention may be incorporated into an LNG transportation system, most notably to store LNG at locations remote to the LNG plant while it awaits subsequent use or further transportation. For example, one or more cryogenic systems 100 may be incorporated into an LNG terminal that receives LNG from marine vessels, rail, truck, air, or other transport.

The cryogenic storage system 100 of the present invention may also find utility when incorporated into an LNG plant, specifically for storing the output of an LNG plant.

Cryogenic storage system 100 of the present invention may also find utility when incorporated into a land or marine transportation vehicle, non-limiting examples of which include truck, trailer, boat, barge, ship, rail car, cargo container, and the like.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

What is claimed is:

1. An apparatus comprising:

a sealed containment box;

a multiplicity of tanks positioned within the box;

a pump system positioned within the box and in liquid communication with the tanks; and a vaporizer positioned outside the box and in liquid communication with the pump system;

wherein the box is supported by a foundation and wherein the vaporizer comprises a heat exchange fluid discharge line positioned in the foundation.

2. The apparatus of claim 1, wherein the box is insulated and filled with an inert gas.

3. The apparatus of claim 1, wherein the tanks comprise cylindrical tanks arranged parallel to each other, and manifolded together for filling in parallel, series, or both.

4. The apparatus of claim 1, wherein the vaporizer is supported by the box.

5. The apparatus of claim 1, wherein the box comprises at least one internal dividing wall dividing the box into at least two compartments.

6. The apparatus of claim 1, wherein the tanks comprise a cryogenic fluid.

7. The apparatus of claim 1, wherein the tanks comprise LNG.

8. An apparatus comprising:

a sealed containment box, comprising a tank section, and a pump section;

a multiplicity of tanks positioned within the box;

a pump system positioned within the box and in liquid communication with the tanks;

a vaporizer positioned outside the box and in liquid communication with the pump system;

wherein the tank section comprises tanks and defines an impoundment section outside the tanks having a volume sufficient to hold any contents in the tanks, and the pump section defines an impoundment section having a volume sufficient to hold the contents of at least one tank.

9. The apparatus of claim 8, wherein the box is insulated and filled with an inert gas.

10. The apparatus of claim 8, wherein the tanks comprise cylindrical tanks arranged parallel to each other, and manifolded together for filling in parallel, series, or both.

11. The apparatus of claim 8, wherein the vaporizer is supported by the box.

12. The apparatus of claim 8, wherein the box is supported by a foundation, and wherein the vaporizer comprises a heat exchange fluid discharge line positioned in the foundation.

13. The apparatus of claim 8, wherein the box comprises at least one internal dividing wall dividing the box into at least two compartments.

14. The apparatus of claim 8, wherein the tanks comprise a cryogenic fluid.

15. The apparatus of claim 8, wherein the tanks comprise LNG.

16. An apparatus comprising:

a land or marine vehicle;

a sealed containment box supported by the vehicle;

a tank system comprising a multiplicity of tanks positioned within the box;

a pump system positioned within the box and in liquid communication with the tanks;

a vaporizer positioned outside the box and in liquid communication with the pump system;

wherein the box is supported by a foundation, and wherein the vaporizer comprises a heat exchange fluid discharge line positioned in the foundation.

17. The apparatus of claim 16, wherein the tank system comprises tanks and defines an impoundment section outside the tanks having a volume sufficient to hold any contents in the tanks, and the pump system defines an impoundment section having a volume sufficient to hold the contents of at least one tank.

18. A method of processing a cryogenic fluid comprising placing cryogenic fluid inside a multiplicity of tanks positioned within the tank system of a containment box, wherein the box comprises a pump system positioned within the box and in liquid communication with the tanks, and comprises a vaporizer positioned outside the box and in liquid communication with the pump system, wherein the box is supported by a foundation, and wherein the vaporizer comprises a heat exchange fluid discharge line positioned in the foundation, further comprising discharging cryogenic fluid through the vaporizer while flowing heat exchange fluid through the discharge line in the foundation, wherein the cryogenic fluid from the multiplicity of tanks is pumped to the vaporizer with the pump system.

* * * * *